United States Patent [19]

Von Gunten

[11] Patent Number: 4,632,490

[45] Date of Patent: Dec. 30, 1986

[54] TOUCH CONTROL CONNECTOR FOR LAMPS

[75] Inventor: Lee Von Gunten, Prospect Heights, Ill.

[73] Assignee: Tri-Lite Electronics, Inc., Northbrook, Ill.

[21] Appl. No.: 800,322

[22] Filed: Nov. 21, 1985

[51] Int. Cl.[4] ..... H01R 13/50

[52] U.S. Cl. ..... 339/154 L; 339/147 R; 339/167; 339/14 R

[58] Field of Search ..... 339/154, 155, 156, 165, 339/167, 147 R, 14 R; 315/194, 196, DIG. 4

[56] References Cited

U.S. PATENT DOCUMENTS

| | | | |
|---|---|---|---|
| 1,830,531 | 11/1931 | Dubilier | 339/167 |
| 3,300,711 | 1/1967 | Duncan | 315/DIG. 4 |
| 3,452,215 | 6/1969 | Alessio | 315/DIG. 4 |
| 3,496,451 | 2/1970 | Duncan | 315/DIG. 4 |
| 3,543,088 | 11/1970 | Garrett | 339/154 L |
| 3,893,019 | 7/1975 | King et al. | 315/194 |

*Primary Examiner*—Gil Weidenfeld
*Assistant Examiner*—David L. Pirlot
*Attorney, Agent, or Firm*—Paul H. Gallagher

[57] ABSTRACT

A self-contained unit that is screwed into a lamp socket, and itself having a socket into which a light bulb is screwed. It includes an internal electronic unit, which functions in response to variation in capacitance, for turning on the bulb, and increasing its brilliance in steps, and turning it off. A sensor bracket includes a finger connected at one end with the electronic unit and extends outwardly from the unit and has a set screw turned in against the lamp socket in which the unit is mounted.

4 Claims, 4 Drawing Figures

TOUCH CONTROL CONNECTOR FOR LAMPS

FIELD OF THE INVENTION

The invention resides in the field of touch control lamps, in which, by means of a person touching a metal portion of the lamp, the light is turned on, varied in brightness, and turned off, respectively, in response to successive touches of the lamp. To provide such lamps, the procedure has been to incorporate an electrical control unit in an adapter or insert member that is threaded in the usual socket in the lamp, and itself is provided with a socket for receiving the light bulb. The adapter is provided with an exterior contact element for making electrical engagement with the exterior of the socket in the lamp. Heretofore, it has been extremely difficult, and practically impossible to make such electrical engagement effectively.

OBJECTS OF THE INVENTION

A principal object of the invention is to provide an adapter of the character referred to, in the use of which the difficulties referred to in making such electrical engagement are overcome.

Another and more specific object is to provide such an adapter of the character referred to, having such mechanical construction as to be especially effective in penetrating through coatings such as lacquer, usually provided on the exterior of lamp sockets, which otherwise tend to prevent good contact engagement with the metal under the coating.

DESCRIPTION OF A PREFERRED EMBODIMENT

In the drawings

Referring to the invention in general, the invention is embodied in an adapter that can be applied to a conventional lamp, and utilzing a conventional light bulb. The adapter is threaded into the usual socket provided in the lamp, and the adapter itself has a socket into which the light bulb is threaded. The adapter utilizes an electronic unit for producing certain control effects, but that electronic unit is of known character, and the present invention is directed to the mechanical construction of the adapter, embodying that electronic unit. The function of the electronic unit is to effect different degrees of illumination, and turning on and off of the light bulb, in response to a person touching metal portions of the lamp.

By so touching a metal portion the bulb may be turned on, and increased or decreased in illumination, either in steps, or gradually in stepless or "ramp" fashion, and then turned off.

Figure 1:
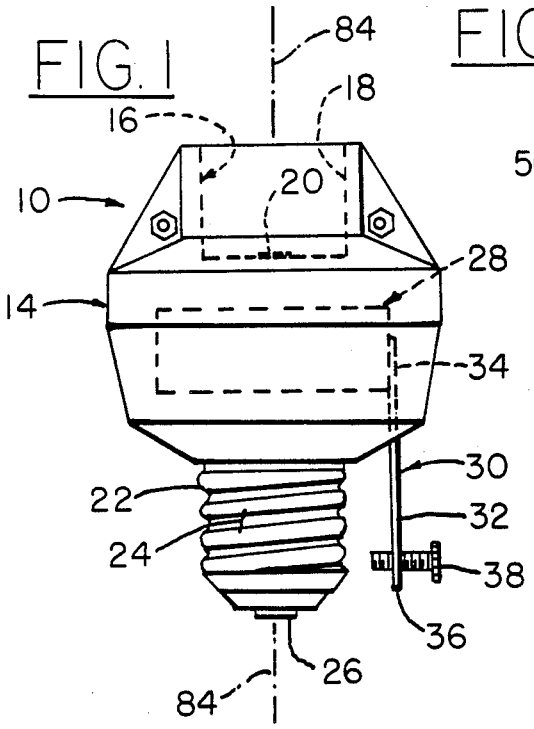
FIG. 1 is a side view of the adapter embodying the features of the invention.
Figure 2:
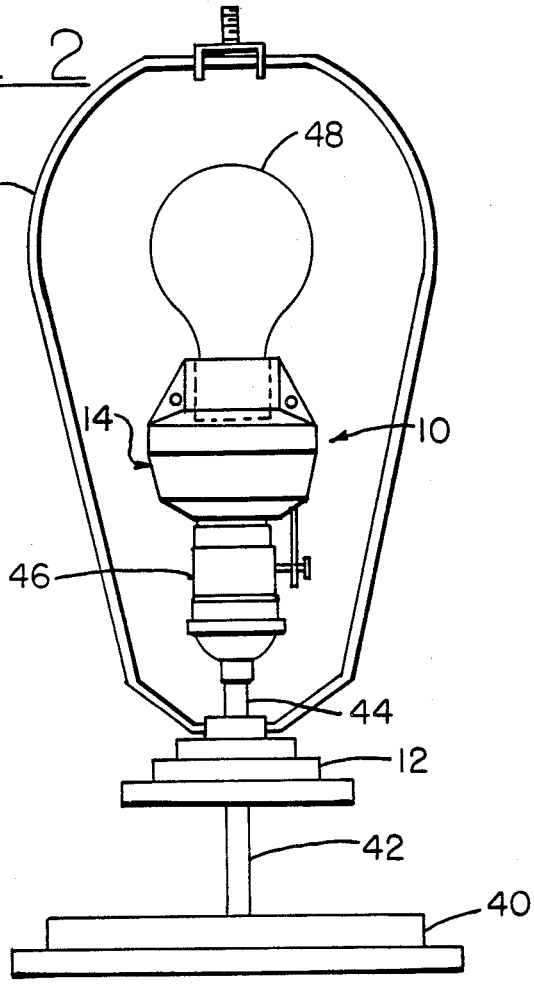
FIG. 2 is a side view showing the adapter mounted in a lamp with a light bulb therein.

The adapter itself is indicated at 10 and is shown alone in FIG. 1, and in FIG. 2 it is shown mounted in a lamp 12.

The adapter 10 includes a body 14 which is of insulation material and may be of any suitable such material, such as plastic. The adapter has a top socket 16 which is constructed similarly to the socket in an ordinary lamp, and includes a female screw shell 18 having a center contact 20. The adapter also includes a base 22 having a male screw 24 and a center contact 26. The base 22 can be fitted in the socket of an ordinary lamp.

The adapter 10 also includes an electronic unit 28 shown diagrammatically in FIG. 1 and referred to again hereinbelow. Additionally the adapter includes a sensor bracket 30 including a finger 32 having an inner end 34 positioned within the body 14 of the adapter and cooperating with the electronic unit 28 as referred to again hereinbelow. The finger 32 has a free end 36 in which is mounted a set screw 38, the inner end of which has a penetrating edge such as a point or circle.

The lamp 12, as indicated above may be conventional, but it is pointed out that is has a number of elements of metal, serving as electrically conductive elements. The lamp includes a base 40 on which is mounted a stem or post 42, the upper end of which is indicated at 44. Mounted on the upper end of the post 42 is a conventional lamp socket member 46 into which the adapter 10 is fitted, and a light bulb 48 is fitted in the socket 16 of the adapter. The lamp may also include a harp 50 mounted on the post 42, for supporting a shade.

The metal electrically conductive elements or portions of the lamp are contiguous, or electrically interconnected, this enabling the user to touch any of those various elements of metal to produce a control signal for controlling the illumination of the light bulb 48. In the present case the base 40, the post 42 and its upper end 44, the socket member 46 and the harp 50 are of metal and interconnected, and the user, for producing the control effect referred to, may touch any one of these elements for correspondingly controlling the illumination of the light bulb.

Figure 3:
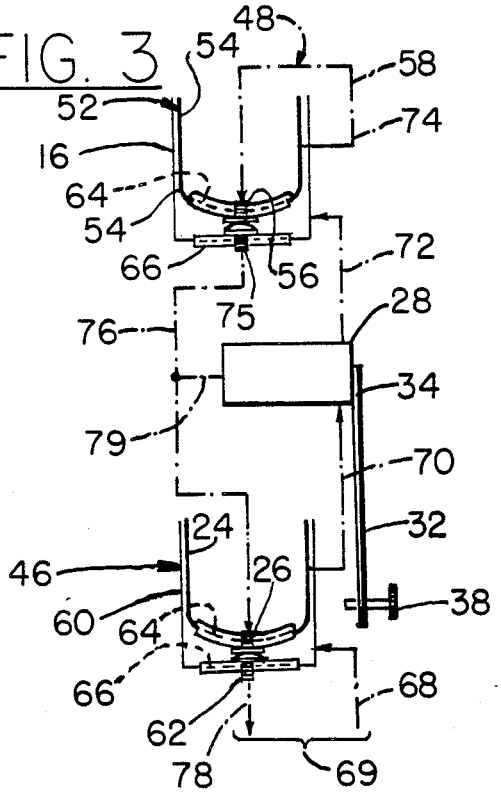
FIG. 3 is a diagram of a portion of the circuit utilized in the adapter and lamp.

Reference is directed to FIG. 3 showing a diagram of the various electric and electronic elements and circuit portions in the lamp, together with certain physical construction elements thereof. The light bulb 48 is of conventional construction, having a base 52 with a male screw 54 thereon fitted in the socket 16 of the adapter, and of course in electrical contact engagement therewith. The light bulb 48 is indicated by a dot-dash line 58 which may represent the filament of the lamp, the lamp having a center contact 56. The male screw 54 and socket 16 have insulation 64, 66 insulating the respective center contacts 56, 75.

The socket member 46 of the lamp is also shown in FIG. 3, having a female screw shell 60 and a center contact 62. The socket 60, and male screw 24 of conventional construction, also include insulation, indicated diagrammatically at 64, 66 between the shell, and the corresponding center contact.

The electrical circuit through the light bulb for illuminating it, includes a conductor element 68 leading from a source 69 to the female screw shell 60; from that shell, and from the male screw 24 connected therewith, another conductor element 70 leads to the electronic unit 28; from the latter another conductor element 72 leads to the female shell 16 in the adapter; and from this female shell 16, and from the male screw 54 connected therewith, is another conductor element 74 constituted by the filament 58 of the lamp; this conductor element 74, through the filament, leads to the center contact 56, of the bulb, this center contact making contact with the center contact 75 in the top socket 16, and leading from that contact is another conductor element 76; the latter conductor element leads to the center contact 26, of the unit and thereby the center contact 62 and finally to a conductor element 78 to the source 69. Another conductor 79 leads from the conductor 76 and provides the hot side of the AC power, completing circuit to the unit 28.

As indicated above, the electronic unit or component 28 is in itself of known character, and may be of the kind disclosed in U.S. Pat. No. 3,715,623, dated Feb. 6, 1973. The details of that unit need not be entered into, but as a feature of the present invention, the sensor bracket 30 is mounted in the unit in control association therewith. The unit 28 includes a circuit board 80 (FIG. 4) which includes a contact element or control element 82. The inner end 34 of the finger 32 of the sensor bracket is mechanically mounted on the circuit board 80 in control association with the control element 82. The details of this mounting need not be entered into, except that the finger is in direct operable contact engagement with that element, and it is mounted mechanically in a strong and relatively rigid fashion. The finger 32 is electrically conductive, and may be of copper or brass and is relatively strong. It is of course rigid longitudinally, but it has limited flexibility transversely. The finger 32 extends longitudinally of the adapter, the adapter having a longitudinal dimension in the direction between the socket 16 and base 22 as indicated by the axis 84, and the finger thus extends generally parallel with a longitudinal element of the male screw base.

When the adapter is in position in the lamp socket, the male base 22 is of course in the socket, and the finger 32 is closely adjacent the outer surfaces of the socket member 46, and it reaches down substantially the length of the male base. The adapter is clamped in position by means of the sensor bracket, by turning the set screw 58 inwardly into engagement with the socket member. Heretofore a great problem existed in establishing firm electrical contact engagement between the adapter and the socket member of the lamp. The socket member and various elements of the lamp, i.e. metal parts, are often coated with lacquer or anodyzing coating, both of which are difficult to penetrate. Accordingly, electrical conductivity from the sensor bracket 30 to contiguous metal parts of the lamp 12 was not attained. One of the reasons why such coatings were not penetrated was that the adapters were not provided with devices that were forceful enough for penetrating through the coating, and that in turn was occasioned by the fact that such forceful elements could not be produced which would permit easy screwing in of the adapter, and that were of pleasing appearance. The sensor bracket 30 of the present device overcomes that difficulty. The set screw 58 can be turned in against the socket member with great force, since the mechanical advantage of a screw is enormous, as is well known. The sensor bracket 30 does not interfere with insertion of the adapter into the lamp socket, since the set screw 38 is normally backed off, and the adapter can thus be inserted as easily as a bulb, but after it is fully inserted, and resting in one position, the set screw is tightened up. The positioning of the finger 32 relative to the base 20 provides great securing force. The force produced by the screw finds reaction from the base 22, these two elements being on opposite sides of the corresponding portion of the lamp socket 46. There is no internal biasing effect of any one component required, but the reaction between the screw and the base produces the securement that is of the great force desired. In the step of turning in the screw 58, reaction is provided from the finger 32, but the flexibility or resillience of the finger that is provided in this direction maintains a continuous forceful engagement of the screw against the socket member 46. The force exerted by the screw and the reaction are balanced through the structure of the adapter.

Figure 4:
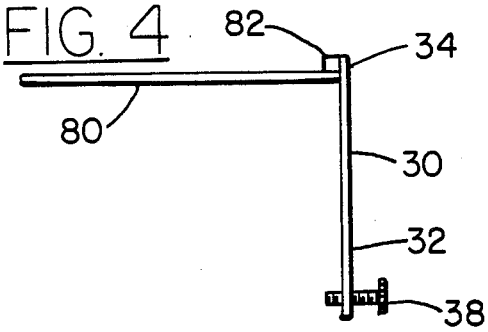
FIG. 4 is a diagrammatic view of certain elements of the adapter.

It is pointed out that the circuit for controlling the electronic unit 28, known as a "touch circuit", is insulated from the electrical circuit through the light bulb, as is known. All of the metal parts of the lamp referred to, are interconnected, and one of them is connected with the sensor bracket 30 which is connected in the electronic unit 28 as indicated in FIG. 4 with the one control element 82 therein. Thus touching any of the metal parts of the lamp is safe from any possible contact with electrical circuit through the light bulb.

I claim:

1. A touch control adapter for a lamp having a socket member with interior contacts for engagement with corresponding contacts on an electric lamp, the socket member also having an outer metal sheath, and the lamp including metal portions which, with said socket sheath, are contiguous, and form a continuous electrically conductive path to the socket sheath, said adapter comprising, a body having a base including a male screw and a center contact, the body also having a top socket for receiving the base of a light bulb, and including a female screw shell and a center contact, said center contacts being interconnected, the adapter incorporating an electronic control unit electrically interposed between said male screw and female screw, the adapter also incorporating a clamp for securing the adapter to the lamp socket, including a sensor bracket having an inner end in the body of the adapter and mechanically mounted therein and having electronic connection with the electronic control unit therein, independently of electrical circuitry through the light bulb, and having a free end extending outwardly from the body and adjacent the socket sheath when the adapter is in the lamp socket, and a securing screw in the free end of the sensor bracket operable on turning thereof for electrically and clampingly engaging said socket sheath.

2. A touch control adapter according to claim 1 wherein, the clamp has a normal retracted inactive position, and when it is in such position, the adapter can be screwed into a lamp socket unimpeded by the clamp, and when the adapter is so screwed in, the clamp can be moved into clamping position.

3. A touch control adapter according to claim 1 wherein, the body of the adapter includes, as a part of said electronic control unit, a circuit board, said sensor bracket having its inner end mechanically mounted on said circuit board, said sensor bracket including a finger extending outwardly from the body of the adapter body, and being rigid longitudinally but having limited flexibility in transverse directions toward and from the lamp socket, and said securing screw having a pointed end capable of penetrating through coatings commonly found on metal parts of electric lamps including lacquer and anodyzing.

4. A touch control adapter according to claim 3 wherein, the adapter has a longitudinal direction extending between its said top socket and base, said finger extends longitudinally of the adapter, and substantially parallel with an adjacent longitudinal element of the base, said finger being thereby so relatively arranged that force exerted by turning in of said securing screw meets reaction from the base of the adapter, and thereby said force and reaction are exerted against the outer and inner surfaces of the lamp socket and are balanced through the structure of the adapter.

* * * * *